US011434106B2

(12) United States Patent
Gireddy et al.

(10) Patent No.: US 11,434,106 B2
(45) Date of Patent: Sep. 6, 2022

(54) ELEVATOR CONTROL TO AVOID HAZARDOUS CONDITIONS

(71) Applicant: Otis Elevator Company, Farmington, CT (US)

(72) Inventors: Jayapal Reddy Gireddy, Telangana (IN); Raghavendra Rao Veera Yerramsetty, Telangana (IN); Putla Vasudev Dayasagar, Telangana (IN); Ashok Chikkur, Telangana (IN); Asadur Rahaman, Telangana (IN); Srinivasa Krishna Mulukutla, Telangana (IN); Sailaja Sreeteja, Telangana (IN); Sudharshan Karanam, Telangana (IN); Prasad Babu Lakshmipathy, Telangana (IN); Rajinikanth Pusala, Telangana (IN)

(73) Assignee: OTIS ELEVATOR COMPANY, Farmington, CT (US)

( * ) Notice: Subject to any disclaimer, the term of this patent is extended or adjusted under 35 U.S.C. 154(b) by 575 days.

(21) Appl. No.: 16/544,450

(22) Filed: Aug. 19, 2019

(65) Prior Publication Data

US 2020/0055698 A1 Feb. 20, 2020

(30) Foreign Application Priority Data

Aug. 20, 2018 (IN) ..... 201811031127

(51) Int. Cl.
*B66B 5/02* (2006.01)
*B66B 13/14* (2006.01)
*B66B 5/00* (2006.01)

(52) U.S. Cl.
CPC ..... *B66B 5/024* (2013.01); *B66B 13/143* (2013.01); *B66B 5/0031* (2013.01)

(58) Field of Classification Search
CPC ..... B66B 5/024; B66B 5/02; B66B 5/0031; B66B 11/024; B66B 2201/20;
(Continued)

(56) References Cited

U.S. PATENT DOCUMENTS 6,000,505 A 12/1999 Allen
6,715,586 B1 4/2004 Shubin
(Continued)

FOREIGN PATENT DOCUMENTS

CN 2683611 Y 3/2005
CN 101389558 A 3/2009
(Continued)

OTHER PUBLICATIONS

Prasad, Nagendra; "Optimization of Elevator Services Using Machine Learning";Jul. 2016; vol. 3, Issue 7; International REsearch Journal of Engineering and Technology, IRJEI; 6 pages.
(Continued)

*Primary Examiner* — Marlon T Fletcher
(74) *Attorney, Agent, or Firm* — Cantor Colburn LLP

(57) ABSTRACT

Disclosed is an elevator system for a multilevel architectural structure, the system having: a system controller, an elevator and an elevator controller, wherein the system controller and elevator controller communicate over a network, multi-level hoistway in which the elevator travels, the multi-level hoistway including a plurality of egress levels, including a first egress level, the first level being a primary egress level, wherein during an alarm condition the system, when the primary level is inaccessible, performs an emergency assessment of identifying a safe level of the plurality of levels at which to discharge passengers, the assessment comprising obtaining a smoke density profile for the egress levels, the profile illustrating a distribution of smoke within the multilevel structure, analyzing the smoke density profile, iden-
(Continued)

tifying a safe level having a smoke density that is safe, and instructing the elevator to discharge passengers on the safe level.

20 Claims, 8 Drawing Sheets

(58) Field of Classification Search
CPC . B66B 2201/4669; B66B 5/027; B66B 5/021; B66B 3/002; B66B 2201/222; B66B 5/00
See application file for complete search history.

(56) References Cited

U.S. PATENT DOCUMENTS

| | | | |
|---|---|---|---|
| 7,182,174 | B2 | 2/2007 | Parrini et al. |
| 7,210,564 | B2 | 5/2007 | Kawai |
| 7,588,126 | B2 | 9/2009 | Siikonen et al. |
| 7,621,378 | B2 | 11/2009 | Kiyoji |
| 7,743,889 | B2 | 1/2010 | Kawai |
| 7,954,603 | B2 | 6/2011 | Hikita et al. |
| 7,963,372 | B2 | 6/2011 | Hikita |
| 8,245,819 | B2 | 8/2012 | Hikita et al. |
| 8,493,230 | B2 | 7/2013 | Hikita et al. |
| 9,921,068 | B2 | 3/2018 | Harvey |
| 2008/0302609 | A1 | 12/2008 | Siikonen |
| 2015/0056905 | A1 | 2/2015 | Baek |
| 2017/0369275 | A1 | 12/2017 | Saraswat et al. |
| 2020/0055698 | A1* | 2/2020 | Gireddy ..... B66B 13/143 |

FOREIGN PATENT DOCUMENTS

| | | | | |
|---|---|---|---|---|
| CN | 102862892 | A | | 1/2013 |
| CN | 103204418 | A | | 7/2013 |
| CN | 106882669 | A | * | 6/2017 |
| CN | 107244600 | A | * | 10/2017 |
| CN | 107473042 | A | * | 12/2017 |
| CN | 108163651 | A | * | 6/2018 |
| EP | 1004536 | A1 | | 5/2000 |
| EP | 3190077 | A1 | | 7/2017 |
| KR | 20140106469 | A | | 9/2014 |
| WO | WO-2004101418 | A1 | * | 11/2004 ..... B66B 5/024 |

OTHER PUBLICATIONS

CN Office Action; Application No. 201910764020.9; dated Sep. 9, 2020; 7 pages.
Extended European Search Report; Application No. 19192706.0; dated Mar. 31, 2020; 7 pages.

* cited by examiner

ELEVATOR CONTROL TO AVOID HAZARDOUS CONDITIONS

CROSS-REFERENCE TO RELATED APPLICATION

This application claims the benefit of Indian Patent Application No. 201811031127 filed Aug. 20, 2018, which is incorporated herein by reference in its entirety.

The embodiments herein relate to elevator control and more specifically to elevator control to avoid hazardous conditions.

BACKGROUND

Elevator systems may stop to a nearest designated floor in either direction based on a predetermined configuration when fire emergencies occur. This may lead to elevators stopping on floors in which a hazard such as smoke or fire is present. In addition, if a fire occurs on all designated rescue landings, an elevator may travel to a top landing and evacuate the passengers at that location, which may lead to an increased risk to the passengers, a delay in a rescue operation, an increase in complexity and/or challenge for the rescue mission, a cost increase for the rescue (such as using aerial evacuation.

BRIEF SUMMARY

Disclosed is an elevator system for a multilevel architectural structure, the system comprising: a system controller, an elevator and an elevator controller, wherein the system controller and elevator controller communicate over a network, multi-level hoistway in which the elevator travels, the multi-level hoistway including a plurality of egress levels, including a first egress level, the first level being a primary egress level, wherein during an alarm condition the system, when the primary level is inaccessible, performs an emergency assessment of identifying a safe level of the plurality of levels at which to discharge passengers, the assessment comprising obtaining a smoke density profile for the egress levels, the profile illustrating a distribution of smoke within the multilevel structure, analyzing the smoke density profile, identifying a safe level having a smoke density that is safe for passengers, and instructing the elevator to discharge passengers on the safe level.

In addition to one or more features and elements disclosed in this document, or as an alternate, the assessment includes: identifying a set of levels having a smoke density that is safe for passengers, determining a relative distance between the elevator and the each of the levels in the first set of levels, and instructing the elevator to discharge passengers on the nearest safe level.

In addition to one or more features and elements disclosed in this document, or as an alternate, the assessment includes: ranking the first set of levels based on distance of each level to the elevator and smoke density at each level, wherein a highest ranked level is a safest level in the set of levels, and instructing the elevator to discharge passengers on the highest ranked level.

In addition to one or more features and elements disclosed in this document, or as an alternate, the smoke density profile accounts for smoke densities in one or more of stairwells, pathways to stairwells, and within the hoistway at each egress level.

In addition to one or more features and elements disclosed in this document, or as an alternate, analyzing the profile includes accounting for data obtained from reference statistics.

In addition to one or more features and elements disclosed in this document, or as an alternate, the system dynamically updates the emergency assessment throughout the emergency and redirects the elevator upon updating a safest level for passenger discharge.

In addition to one or more features and elements disclosed in this document, or as an alternate, each of the plurality of levels includes one of a respectively plurality of smoke detectors, including a first smoke detector disposed on the first egress level, and wherein at least the first smoke detector is operationally controlled by a first smoke detector controller for transmitting smoke density data to the system.

In addition to one or more features and elements disclosed in this document, or as an alternate, the system comprises a smoke monitoring system for receiving the smoke density data from the plurality of smoke detectors, developing the smoke density profile, and forwarding the profile to the system.

In addition to one or more features and elements disclosed in this document, or as an alternate, the system comprises a building management system for receiving the smoke density profile from the smoke monitoring system and performing the emergency assessment.

In addition to one or more features and elements disclosed in this document, or as an alternate, the building management system transmits the identified of the safe level to the elevator controller.

Further disclosed is an emergency assessment method for an elevator system in a multilevel architectural structure, the system including one or more features and elements disclosed in this document.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
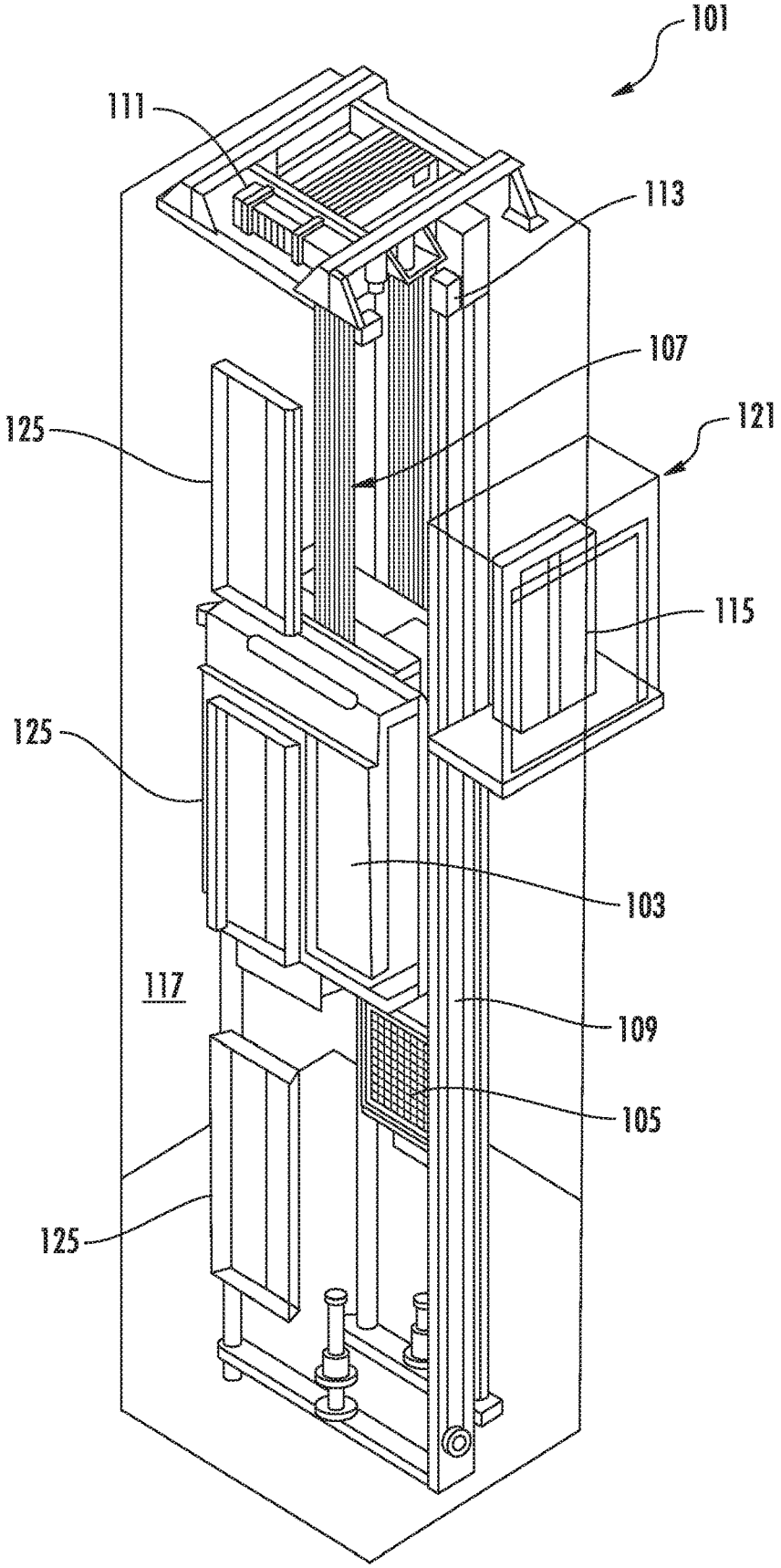
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft or hoistway 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

FIGS. 2-8 illustrate additional technical features associated with one or more disclosed embodiments. Features and elements disclosed in FIGS. having nomenclature and/or illustrative appearance that is the same or similar to that in FIG. 1 may be similarly construed even though nomenclature and/or numerical identifiers may differ.

Figure 2:
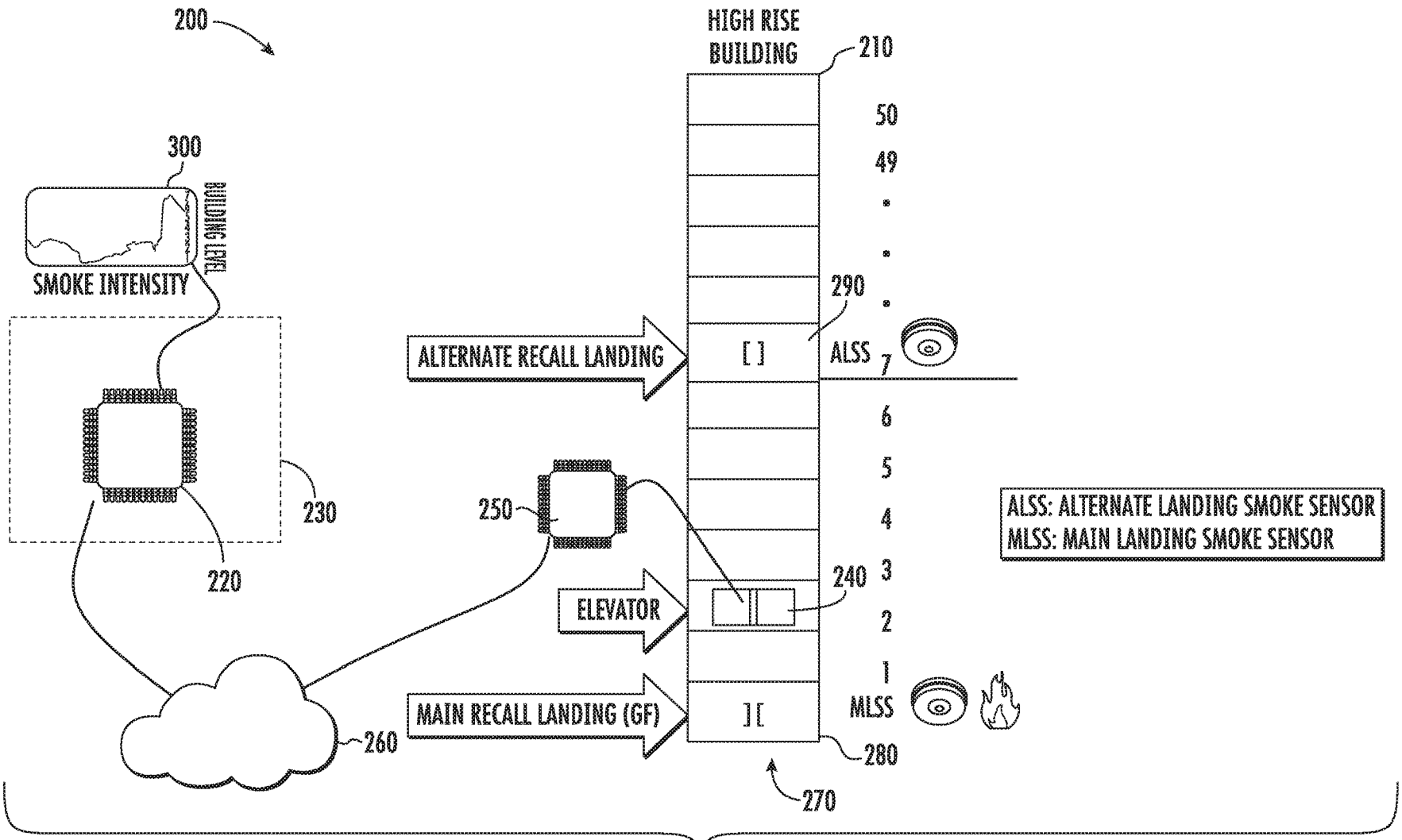
FIG. 2 illustrates features of a disclosed embodiment.

Turning to FIG. 2, disclosed is an elevator system 200 for a multilevel architectural structure 210. The structure may be an office or residential building or the like, and the levels may be floors. The system 200 may comprise a system controller 220. The system controller 220 may be mounted in a system hub 230, disclosed below. Reference in this document to operational features of the system 200 may also be construed as reference to the system controller 220 for implementing controls necessary to support such operational features. Other components and respective controllers disclosed herein shall be similarly construed.

The system 200 may include an elevator 240 and an elevator controller 250. The system 200 and elevator 240 may communicate over a network 260. A multi-level hoistway 270 is illustrated in which the elevator 240 may travel. The multi-level hoistway 270 may include a plurality of egress levels, including a first level 280. The first level 280 may be a primary egress level.

Figure 3:
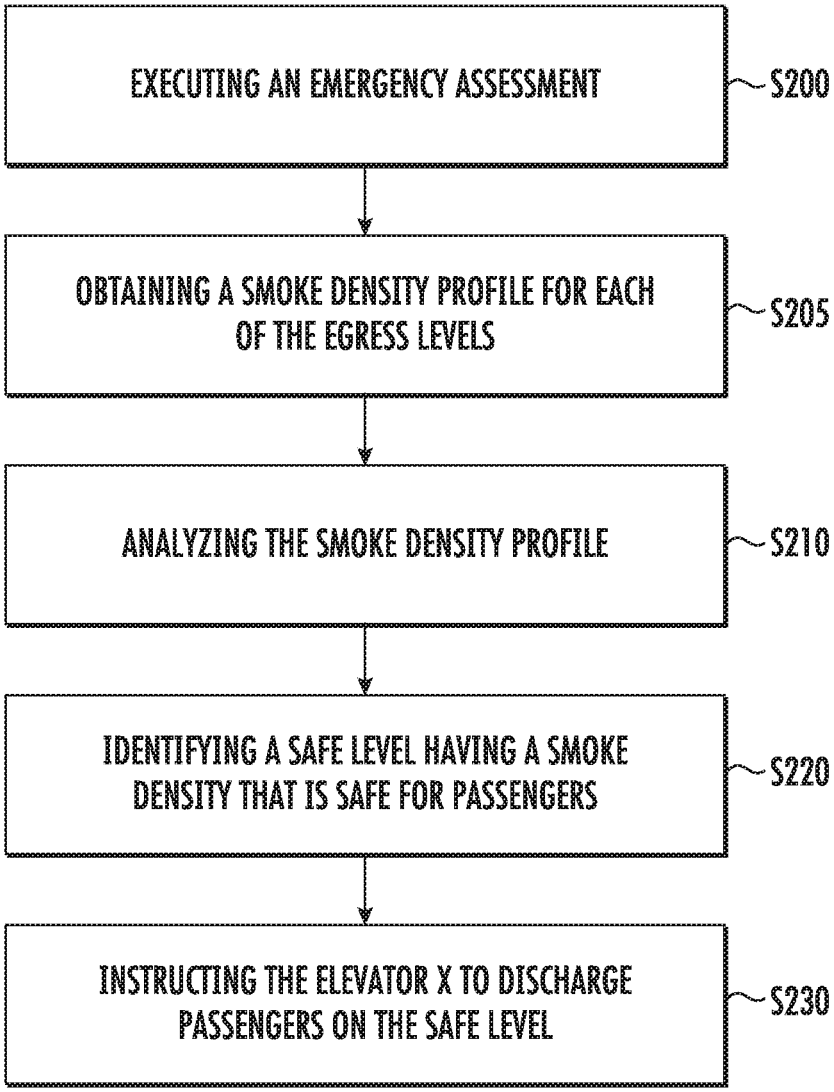
FIG. 3 illustrates a process for operating the features of FIG. 2 according to an embodiment.

Turning to FIG. 3, during an alarm condition, when the primary level is inaccessible, the system 200 may perform step S200 of executing an emergency assessment to identify a safe level 290 of the plurality of levels at which to discharge passengers. For the assessment, the system 200 may perform step S205 of obtaining a smoke density profile 300 illustrating a distribution of smoke for each of the egress levels within the multileveled structure 210. That is, some floors may have more or less smoke than other floors. The system 200 may also perform step S210 of analyzing the smoke density profile 300.

In addition, the system 200 may perform step S220 of identifying a safe level 290 having a smoke density that is less than an amount of smoke at which a person can breathe freely without becoming harmed. At the system 200 may perform step S230 of instructing the elevator 240 to discharge passengers on the safe level 290. Process steps are sequentially numbered in this document to facilitate discussion but are not intended to identify a specific sequence of performance of such steps or a requirement to perform such steps unless expressly indicated.

Figure 4:
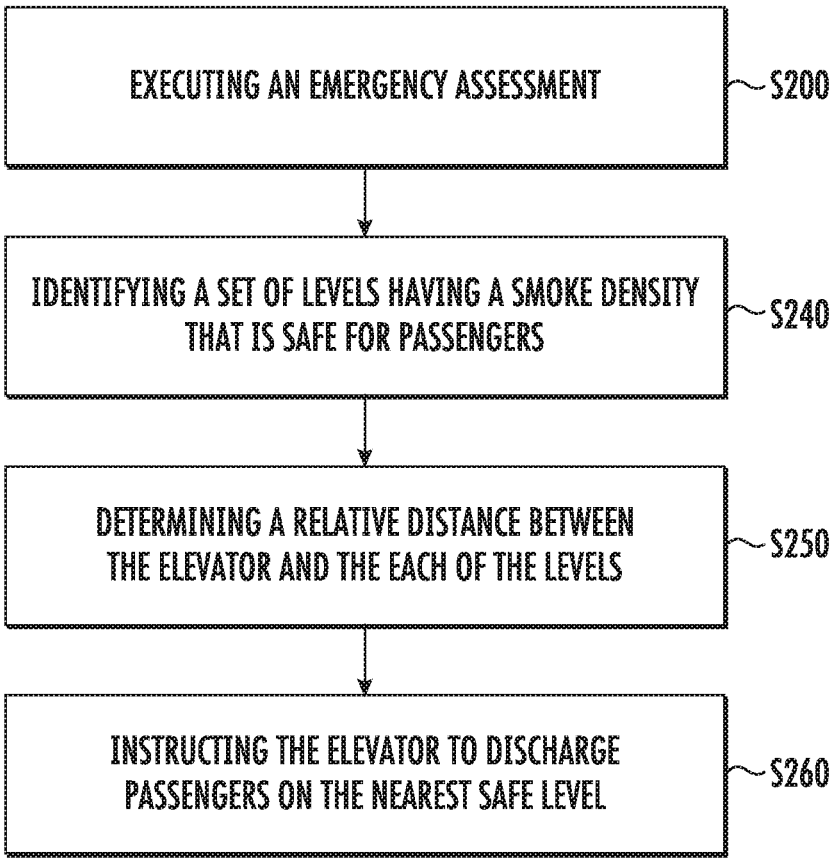
FIG. 4 illustrates an additional process for operating the features of FIG. 2 according to an embodiment.

As illustrated in FIG. 4, in one embodiment the assessment S200 may include the system 200 performing step S240 of identifying a set of levels having a smoke density that is less than an unsafe amount. The system 200 may also perform step S250 of determining a relative distance between the elevator 240 and the each of the levels in the first set of levels. The system 200 may also perform step S260 of instructing the elevator 240 to discharge passengers on the nearest safe level 290.

Figure 5:
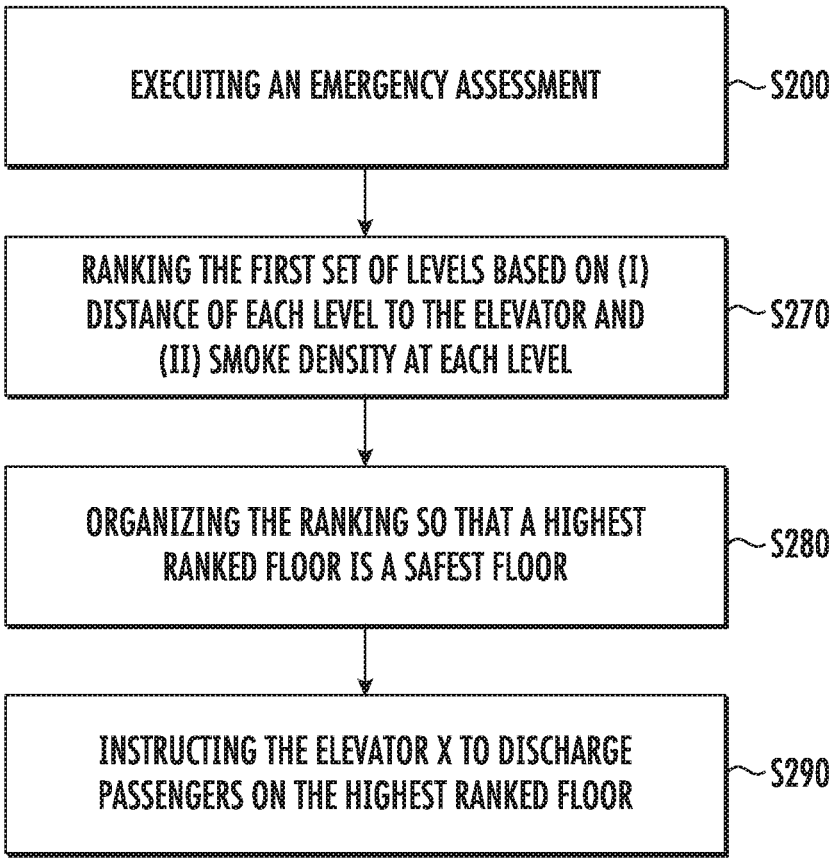
FIG. 5 illustrates an additional process for operating the features of FIG. 2 according to an embodiment.

As illustrated in FIG. 5, in one embodiment the assessment S200 may include the system 200 performing step S270 of ranking the first set of levels based on (i) distance of each level to the elevator and (ii) smoke density at each level. The system 200 may perform step S280 of organizing the ranking so that a highest ranked level is a safest level in the set of level. The system 200 may then perform step S290 of instructing the elevator 240 to discharge passengers on the highest ranked level.

According to an embodiment the smoke density profile 300 may account for smoke densities in one or more of stairwells, pathways to stairwells, and within the hoistway 270 at each egress level. Such a detailed profile may provide additional data with which the system 200 may identify the safe level 290 for passenger dispatch.

Figure 6:
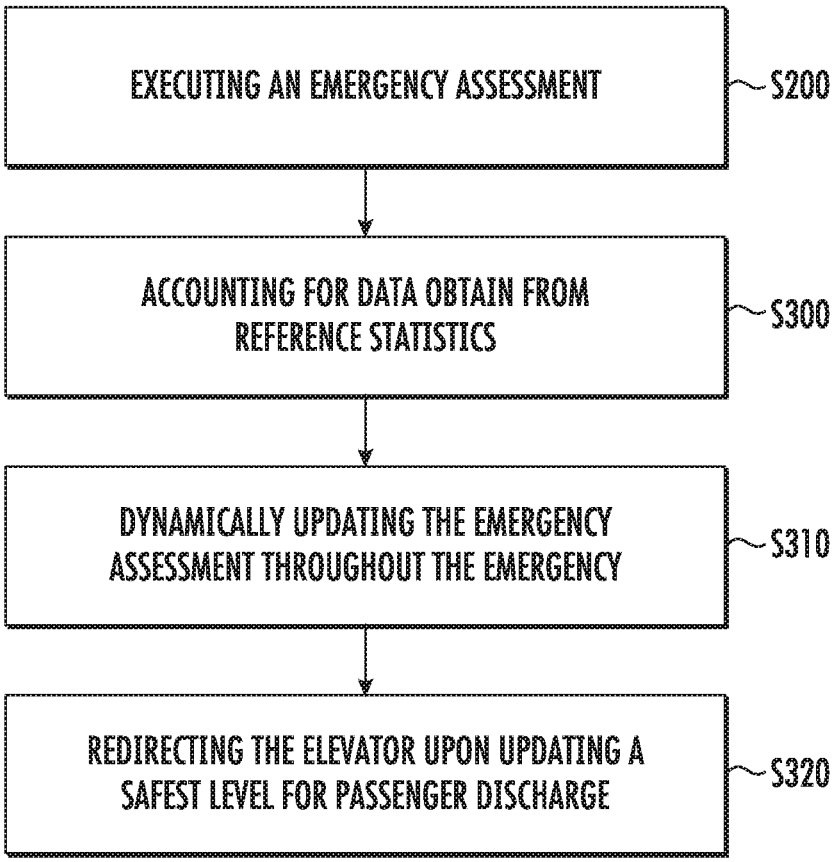
FIG. 6 illustrates an additional process for operating the features of FIG. 2 according to an embodiment.

In addition, turning to FIG. 6, in one embodiment when performing the assessment S200, the system 200 may perform step S300 of accounting for data obtain from reference statistics. Such statistics may account one or more of hazard intensity, rates of smoke and hazard dispersion, and speed at which passengers travel over distances in hazard conditions, both along floors and within stairwells. The system 200 may perform step S310 of dynamically updating the emergency assessment throughout the emergency. During this process the system 200 may perform step S320 of redirecting the elevator 240 upon updating a safest level for passenger discharge.

Figure 7:
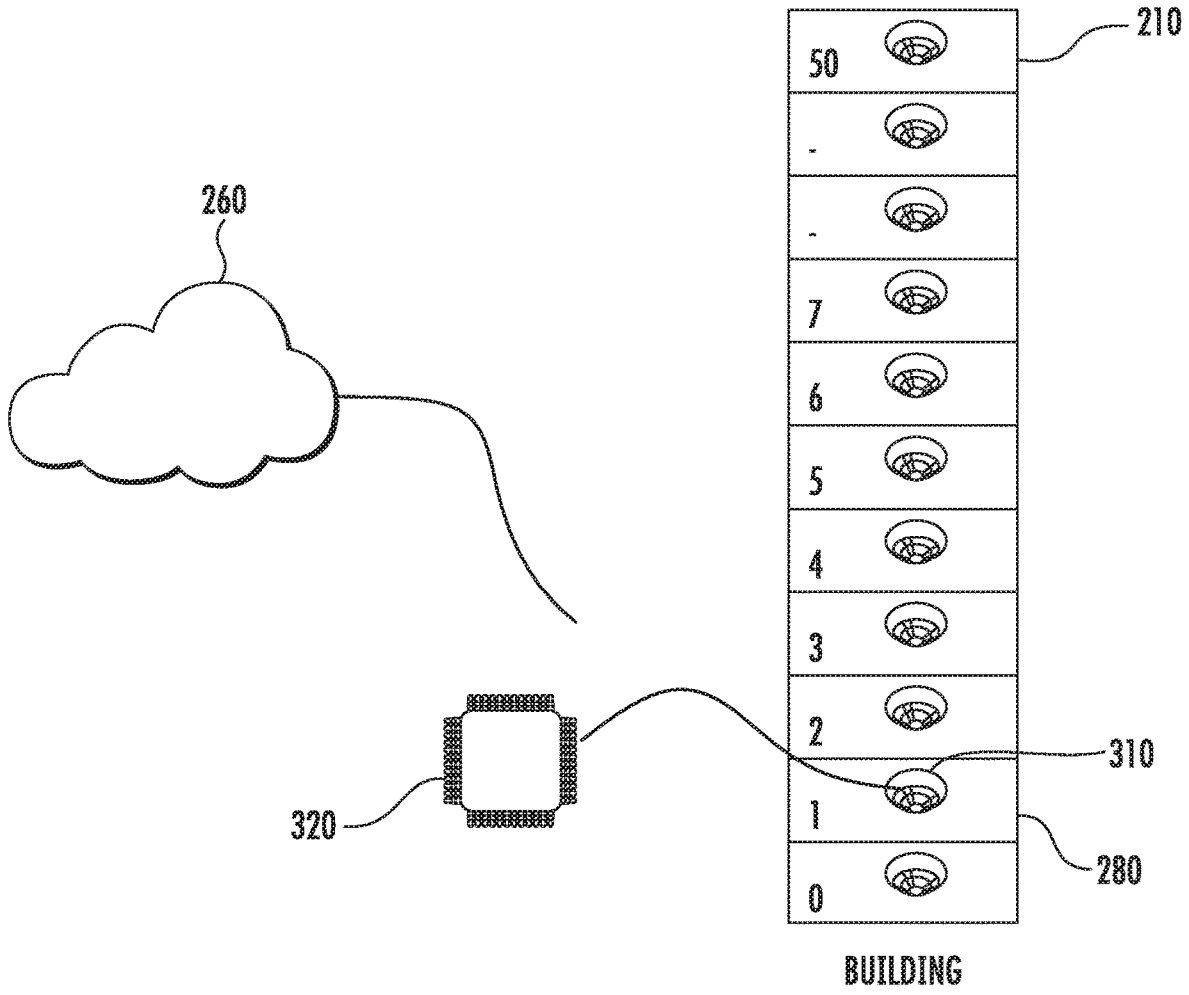
FIG. 7 illustrates additional features of a disclosed embodiment.

As illustrated in FIG. 7 each of the plurality of levels in the structure 210 may include one of a respectively plurality of smoke detectors, including a first smoke detector 310 disposed on the first level 280. At least the first smoke detector 310 is may be operationally controlled by a first smoke detector controller 320 for transmitting smoke density data to the system 200 through, for example, the network 260.

Figure 8:
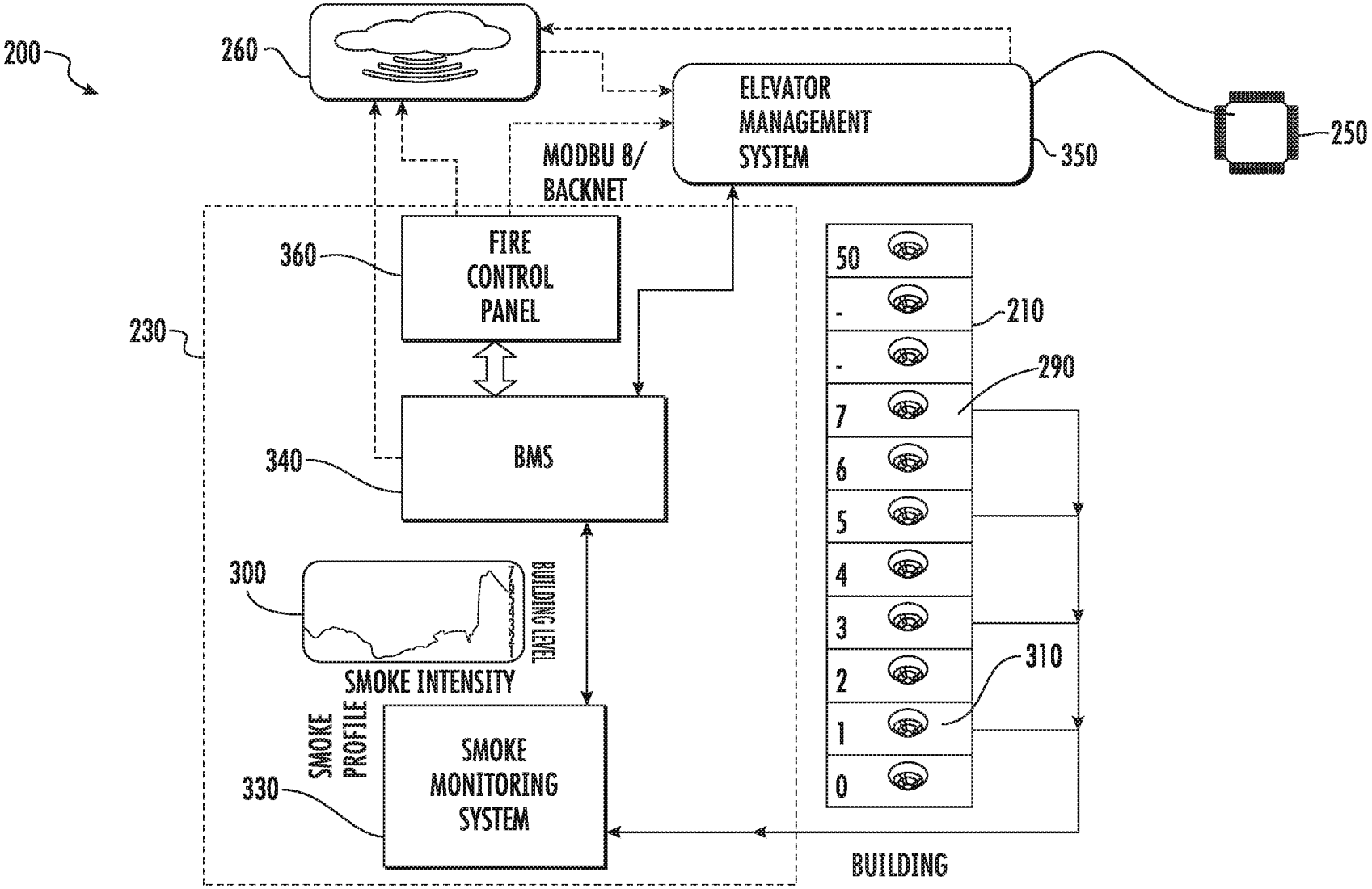
FIG. 8 illustrates additional features of a disclosed embodiment.

Turning to FIG. 8, the system 200 may comprise a smoke monitoring system 330. The smoke monitoring system 330 may receiving the smoke density data from the plurality of smoke detectors, such as the first smoke detector 310, in the structure 210, developing the smoke density profile 300, and forwarding the profile to the system 200. The system 200 of may comprise a building management system 340 for receiving the smoke density profile 300 from the smoke monitoring system 330.

The building management system 340 may identify the safe level 290 for an elevator management system 350 which may include the elevator controller 250. The building management system 340 may also transmit one or more of the profile 300 and the identity of the safe level 290 to a fire control system 360, which may notify first responders. Much of these communications may occur over the network 260. In addition, one or more of the smoke monitoring system 330, the building management system 340 and the fire control system 360 may be part of the system hub 230.

The above disclosed embodiments may increase passenger safety as the elevator may stop near a relatively safe floor, that is, a floor having relatively less smoke intensity among all the alternate discharge floors, as detected by smoke meters. When there is a fire, an elevator may stop at a designated main landing to discharge the passengers. If the main landing smoke sensor is active, the elevator control system may choose an alternate discharge floor based on relative smoke density.

As disclosed above, in one embodiment sensors are installed in all the floors, at exit staircases and inside the hoistway. The system accounts for sensed information by providing a real time update for the exit paths. As a result there may be a decreased risk of harm when passengers are evacuated from the car. The system may take inputs from the sensors, process the real time data, predicts hazard paths based on statistical data, and computes a relatively safest floor in at which to land. The elevator controller may then direct the elevator to the determined landing. In doing so, the elevator controller may override a pre-programmed rescue landing with an updated landing. Once the rescue operation is completed the elevator controller may reset to a default data. Benefits of the above embodiments may include providing a relatively safe and accurate rescue landing considering all egress landings, providing relatively quick evacuation of passengers, and a relatively increased passenger safety. In addition, the benefits may include a relatively lower rescue complexity, for example, for emergency responders, and a reduced rescue cost, which may avoid areal support in certain situations.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An elevator system for a multilevel architectural structure, the system comprising:

a system controller, an elevator and an elevator controller, wherein the system controller and elevator controller communicate over a network, multi-level hoistway in which the elevator travels, the multi-level hoistway including a plurality of egress levels, including a first egress level, the first level being a primary egress level, wherein during an alarm condition the system, when the primary level is inaccessible, performs an emergency assessment of identifying a safe level of the plurality of levels at which to discharge passengers, the assessment comprising obtaining a smoke density profile for the egress levels, the profile illustrating a distribution of smoke within the multilevel structure, analyzing the smoke density profile, identifying a safe level having a smoke density that is safe for passengers, and instructing the elevator to discharge passengers on the safe level.

2. The system of claim 1 wherein the assessment includes:

identifying a set of levels having a smoke density that is safe for passengers, determining a relative distance between the elevator and the each of the levels in the first set of levels, and instructing the elevator to discharge passengers on the nearest safe level.

3. The system of claim 2 wherein the assessment includes:

ranking the first set of levels based on distance of each level to the elevator and smoke density at each level, wherein a highest ranked level is a safest level in the set of levels, and instructing the elevator to discharge passengers on the highest ranked level.

4. The system of claim 3 wherein the smoke density profile accounts for smoke densities in one or more of stairwells, pathways to stairwells, and within the hoistway at each egress level.

5. The system of claim 4 wherein analyzing the profile includes accounting for data obtained from reference statistics.

6. The system of claim 5 wherein the system dynamically updates the emergency assessment throughout the emergency and redirects the elevator upon updating a safest level for passenger discharge.

7. The system of claim 6 wherein each of the plurality of levels includes one of a respectively plurality of smoke detectors, including a first smoke detector disposed on the first egress level, and wherein at least the first smoke detector is operationally controlled by a first smoke detector controller for transmitting smoke density data to the system.

8. The system of claim 7 comprising a smoke monitoring system for receiving the smoke density data from the plurality of smoke detectors, developing the smoke density profile, and forwarding the profile to the system.

9. The system of claim 8 comprising a building management system for receiving the smoke density profile from the smoke monitoring system and performing the emergency assessment.

10. The system of claim 9 wherein the building management system transmits the identified of the safe level to the elevator controller.

11. An emergency assessment method for an elevator system in a multilevel architectural structure, the system including: a system controller, an elevator and an elevator controller, wherein the system controller and elevator controller communicate over a network, multi-level hoistway in which the elevator travels, the multi-level hoistway including a plurality of egress levels, including a first egress level, the first level being a primary egress level, wherein during an alarm condition, when the primary level is inaccessible, the system executes the method, the method comprising:

obtaining a smoke density profile for the egress levels, the profile illustrating a distribution of smoke within the multilevel structure, analyzing the smoke density profile, identifying a safe level having a smoke density that is safe, and instructing the elevator to discharge passengers on the safe level.

12. The method of claim 11 wherein the assessment includes:

identifying a set of levels having a smoke density that is safe amount, determining a relative distance between the elevator and the each of the levels in the first set of levels, and instructing the elevator to discharge passengers on the nearest safe level.

13. The method of claim 12 wherein the assessment includes:

ranking the first set of levels based on distance of each level to the elevator and smoke density at each level, wherein a highest ranked level is a safest level in the set of levels, and instructing the elevator to discharge passengers on the highest ranked level.

14. The method of claim 13 wherein the smoke density profile accounts for smoke densities in one or more of stairwells, pathways to stairwells, and within the hoistway at each egress level.

15. The method of claim 14 wherein analyzing the profile includes accounting for data obtained from reference statistics.

16. The method of claim 15 wherein the system dynamically updates the emergency assessment throughout the emergency and redirects the elevator upon updating a safest level for passenger discharge.

17. The method of claim 16 wherein each of the plurality of levels includes one of a respectively plurality of smoke detectors, including a first smoke detector disposed on the first egress level, and wherein at least the first smoke detector is operationally controlled by a first smoke detector controller for transmitting smoke density data to the system.

18. The method of claim 17 wherein the system comprises a smoke monitoring system for receiving the smoke density data from the plurality of smoke detectors, developing the smoke density profile, and forwarding the profile to the system.

19. The method of claim 18 wherein the system comprises a building management system for receiving the smoke density profile from the smoke monitoring system and performing the emergency assessment.

20. The method of claim 19 wherein the building management system transmits the identified of the safe level to the elevator controller.

* * * * *